US006298621B1

(12) United States Patent
Lee

(10) Patent No.: US 6,298,621 B1
(45) Date of Patent: Oct. 9, 2001

(54) DEVICE FOR INTERCEPTING STAGNANT WATER

(76) Inventor: Nam Seung Lee, Na-302, Samchang Villa, 98-16 Chungpa-dong, 1 ka, Yongsan-ku, Seoul (KR)

( * ) Notice: Subject to any disclaimer, the term of this patent is extended or adjusted under 35 U.S.C. 154(b) by 0 days.

(21) Appl. No.: 09/518,717

(22) Filed: Mar. 3, 2000

(30) Foreign Application Priority Data

Mar. 10, 1999 (KR) ..... 99-3768

(51) Int. Cl.[7] ..... E04B 1/68

(52) U.S. Cl. ..... 52/302.6; 52/60; 52/61; 52/169.14; 52/310; 52/396.02

(58) Field of Search ..... 52/60, 61, 62, 52/97, 169.5, 169.14, 287.1, 302.3, 302.6, 310, 396.02

(56) References Cited

U.S. PATENT DOCUMENTS

| | | | | |
|---|---|---|---|---|
| 3,172,237 | * | 3/1965 | Bradley . | |
| 3,201,910 | * | 8/1965 | Keesee | 52/287.1 |
| 3,968,611 | * | 7/1976 | De Munck | 52/396.02 |
| 4,041,665 | * | 8/1977 | De Munck | 52/396.02 |
| 4,074,492 | | 2/1978 | Simpson et al. . | |
| 4,074,943 | * | 2/1978 | Szugda | 403/174 |
| 4,485,600 | | 12/1984 | Olson . | |
| 4,671,026 | * | 6/1987 | Wissinger | 52/35 |
| 4,977,718 | * | 12/1990 | Hoffman, Sr. | 52/287.1 |
| 5,315,799 | * | 5/1994 | Cullinan | 52/287.1 X |
| 5,649,784 | * | 7/1997 | Ricaud et al. | 404/47 |
| 5,705,002 | * | 1/1998 | Sherry | 52/287.1 X |
| 5,752,353 | * | 5/1998 | Koenig et al. | 52/287.1 X |
| 5,826,391 | * | 10/1998 | Underwood | 52/396.02 X |
| 5,845,456 | | 12/1998 | Read . | |
| 5,988,648 | * | 11/1999 | Schmid | 52/396.02 X |
| 6,026,622 | * | 2/2000 | Schmid | 52/396.02 |

* cited by examiner

*Primary Examiner*—Beth A. Stephan
*Assistant Examiner*—Brian E. Glessner
(74) *Attorney, Agent, or Firm*—R. Neil Sudol; Henry D. Coleman; William J. Sapone

(57) ABSTRACT

A stagnant-water intercepting device for disposition in earthworks is formed by an intercepting member and two auxiliary intercepting plates. The intercepting member has a semi-cylindrical center portion and two side wing portions. The semi-cylindrical center portion and the side wing portions are integrated into a single body. The two auxiliary intercepting plates are respectively provided with a plurality of spaced holes at their exposed portions and fixedly fitted into respective ones of the side wing portions of the intercepting member. The portions of the intercepting plates fitted into the side wing portions of the intercepting member are each provided with a plurality of holes.

3 Claims, 4 Drawing Sheets

PRIOR ART

DEVICE FOR INTERCEPTING STAGNANT WATER

BACKGROUND OF THE INVENTION

1. Field of the Invention

The present invention relates, in general, to devices for intercepting stagnant water and, more particularly, to a device for intercepting stagnant water, which prevents the water stagnated in an earth and sand layer from leaking out of a retaining wall.

2. Description of the Prior Art

Generally, when a great quantity of concrete is applied so as to construct a significantly large structure, such as a retaining wall, a plurality of small holes are made in the concrete while moisture in the concrete is evaporated in the process of hardening the concrete. Such small holes cause the concrete structure to be cracked as the concrete structure is contracted and expanded due to the atmospheric temperatures.

Since the stability of the structure is threatened if cracks are generated in the concrete structure and water is infiltrated into the concrete structure through the cracks, the generation of the cracks should be prevented or the interception of water should be performed.

In the past, there were used techniques wherein the water infiltrated into the concrete structure was discharged out of the structure by the installation of a plurality of water discharge conduits. Of the techniques, a technique wherein panels made of glass fiber were inserted into the retaining wall and the water infiltrated into the retaining wall was guided by the glass fiber panels was disclosed in U.S. Pat. No. 5,845,456.

In order to prevent concrete structures from being cracked due to the contraction and expansion of concrete, there was proposed a technique wherein a wide construction area was divided into small structure units and expanding and contracting strip members were disposed between the structure units.

However, according to the above technique, though the cracks are prevented because spaces exist between the structure units, water leaks through the spaces where the expanding and contracting strip members are disposed, thereby threatening the stability of the construction structure.

Therefore, as shown in FIG. 1, stagnant water intercepting members 20 should be installed additionally in a retaining wall that is constructed at a place that water is easy to infiltrate, such as an underground road, a tunnel, an underground garage, an underground water reservoir and a mountain road, so as to prevent water from leaking through the spaces between the divided construction structures.

Each of the stagnant water intercepting members 20 is fitted into a space between the two expanding and contracting strip members 10 and 10' at its center at a right angle. The retaining wall W is constructed by applying concrete around the stagnant water intercepting members 20.

Such a stagnant water intercepting member 20 is made of soft material, such as soft PVC or rubber, and is formed by integrating into a single body the center portion, which is disposed in the expanding and contracting strip member, and the side wing portions, which are disposed in the concrete. The shape of the stagnant water intercepting member 20 is generally as illustrated in FIG. 1.

When time lapses after an stagnant water intercepting member of soft PVC or rubber is laid in the concrete and the concrete is hardened, the entire surface of the stagnant water intercepting member becomes separated from the concrete, thereby generating a gap between the stagnant water intercepting member and the concrete. Consequently, as illustrated by arrows in FIG. 1, water, which flows into the retaining wall W along one expanding and contracting strip member 10', passes through a gap between the stagnant water intercepting member and the concrete and, subsequently, leaks out of the retaining wall W through another expanding and contracting strip member 10.

SUMMARY OF THE INVENTION

Accordingly, the present invention has been made keeping in mind the above problems occurring in the prior art, and an object of the present invention is to provide a stagnant water intercepting device that prevents water from leaking out of a concrete construction structure.

In order to accomplish the above object, the present invention provides a stagnant water intercepting device, comprising an intercepting member consisting of a semi-cylindrical center portion and two side wing portions, the semi-cylindrical center portion and the side wing portions being integrated into a single body, and two auxiliary intercepting plates respectively and fixedly fitted into each of the side wing portions of the intercepting member.

In addition, the present invention provides a stagnant water intercepting device, comprising a semi-cylindrical center portion and two intercepting side portions, the semi-cylindrical center portion and the intercepting side portions being integrated into a single body, each of the intercepting side portions having a plurality of spaced holes.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
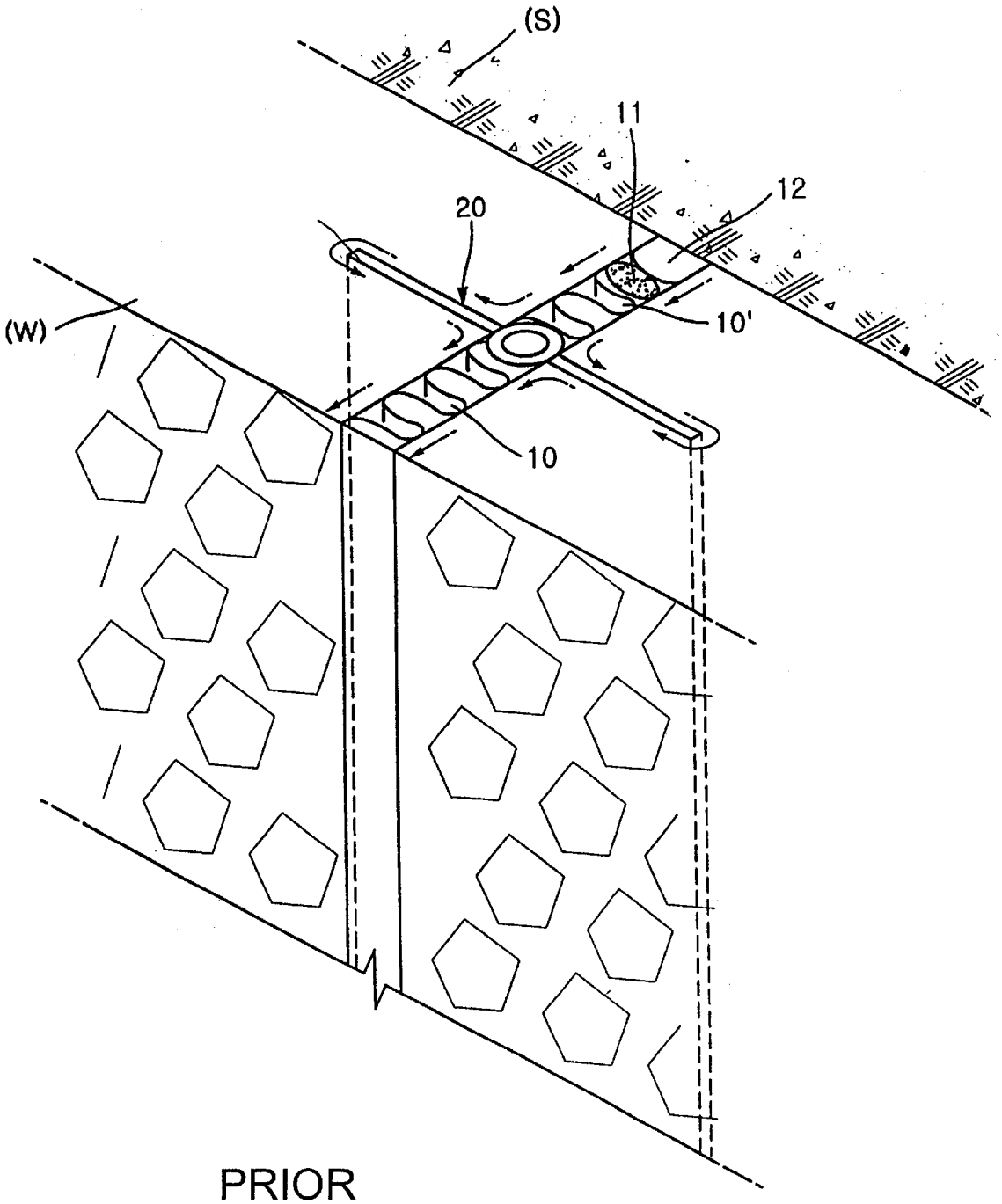
FIG. 1 is a perspective view showing a retaining wall where a conventional stagnant water intercepting device is installed.
Figure 2:
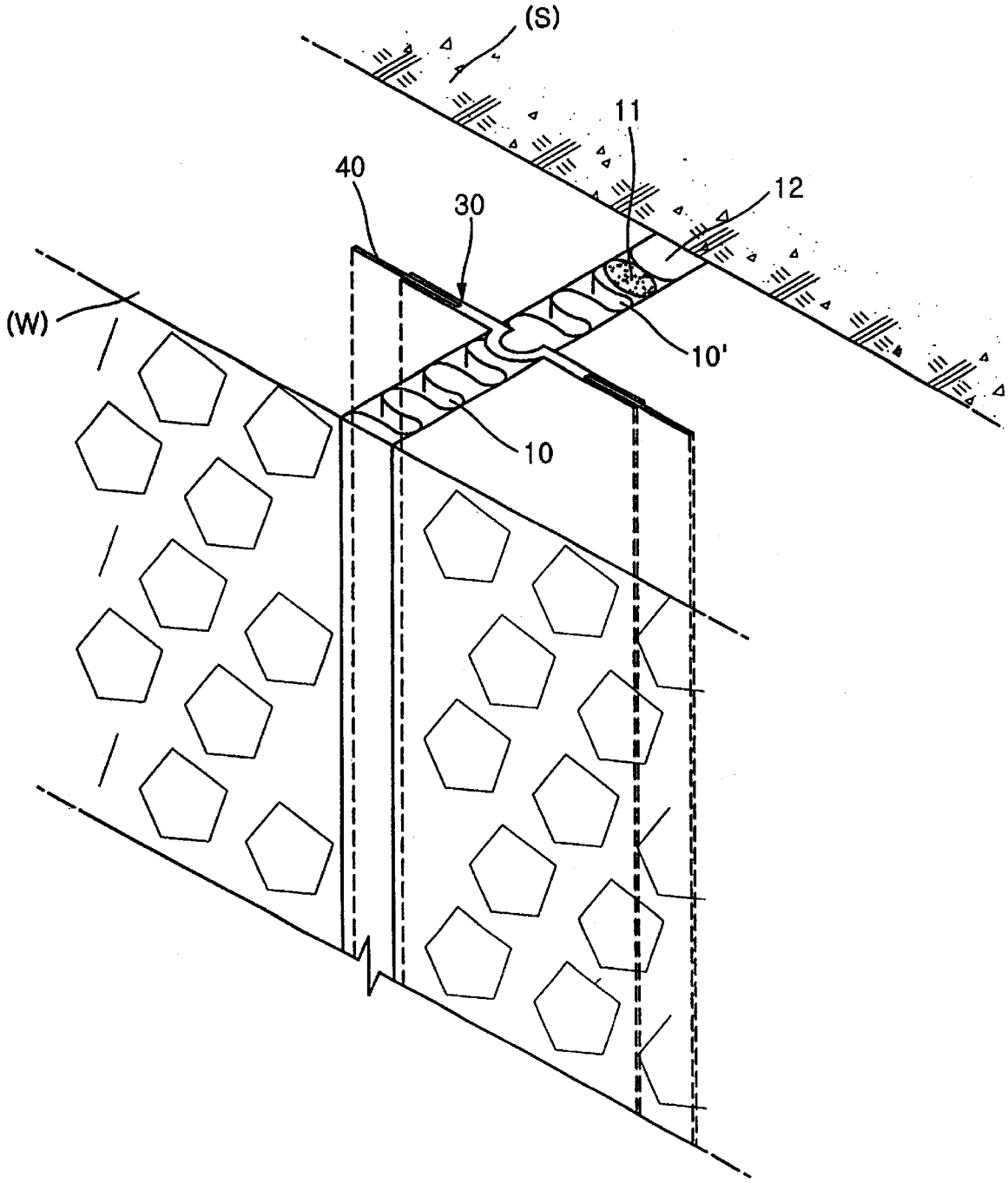
FIG. 2 is a perspective view showing a retaining wall where a stagnant water intercepting device of the present invention is installed.
Figure 3:
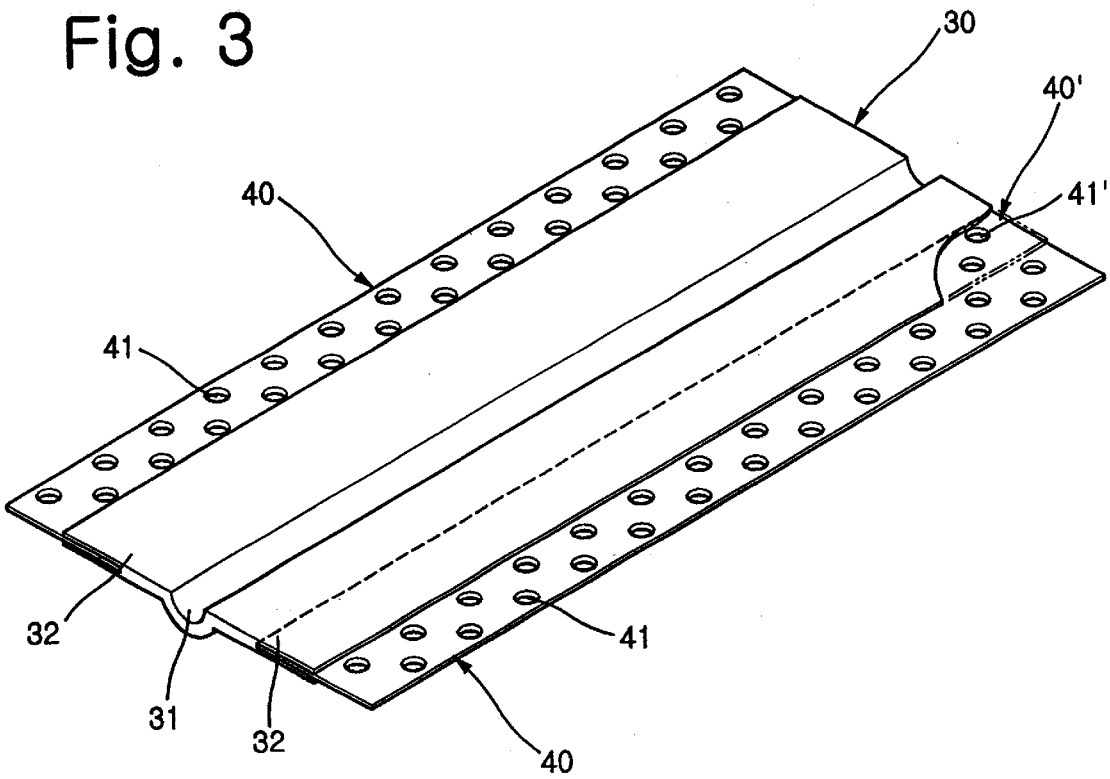
FIG. 3 is a perspective view showing the stagnant water intercepting device of the present invention.
Figure 4:
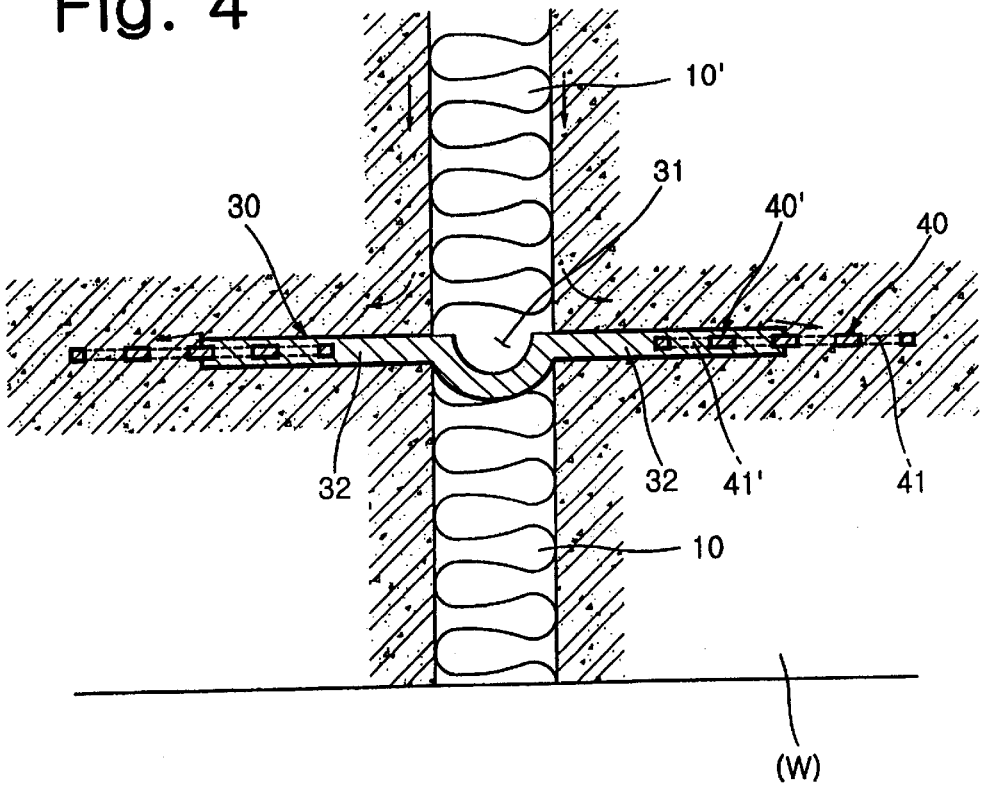
FIG. 4 is a horizontal cross section showing the retaining wall where the stagnant water intercepting device of the present invention is installed.
Figure 5:
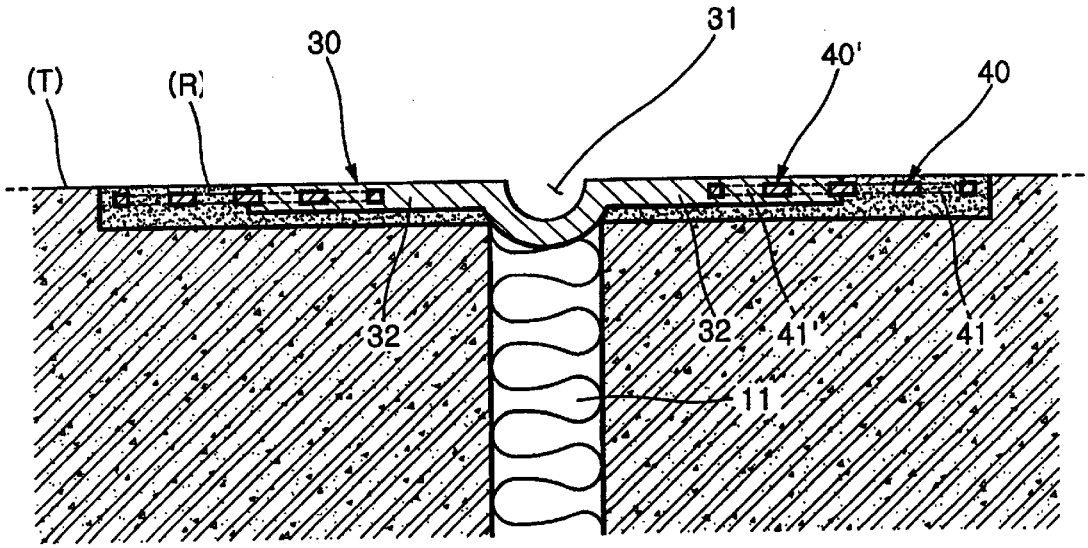
FIG. 5 is a vertical cross section showing the concrete floor where the stagnant water intercepting device of the present invention is installed.

FIG. 2 is a perspective view showing a retaining wall where a stagnant water intercepting device according to the present invention is installed. FIG. 3 is a perspective view showing the stagnant water intercepting device of the present invention.

As shown in FIG. 2, a retaining wall W where the present invention is embodied is constructed as follows. Concrete is applied to the front of an earth and sand heap S so as to provide divided retaining walls W. After the concrete is hardened, expanding and contracting strip members 10 and 10' are disposed between the divided retaining walls W so as to block gaps between the divided retaining walls W by receiving the expansion and contraction of the divided retaining walls W. A backup member 11 and a joint sealing member 12 are disposed between the expanding and contracting strip member 10' and the earth and sand heap S. A stagnant water intercepting device is fitted into space between the two expanding and contracting strip members 10 and 10' at it's center so as to prevent stagnant water in the earth and sand heap S from leaking through a gap between the divided retaining walls W.

The stagnant water intercepting device of the present invention is formed by fitting each of two auxiliary intercepting plates 40 into each of two side wing portions of one intercepting member 30.

The intercepting member 30 consists of a semi-cylindrical center portion 31 and two side wing portions 32, the semi-cylindrical center portion and the side wing portions being integrated into a single body. The intercepting member 30 may be made of soft PVC or rubber well known to persons skilled in the art.

Each of the auxiliary intercepting plates 40 is a steel plate having a plurality of regularly spaced holes 41 and 41'. The two auxiliary intercepting plates 40 are respectively and fixedly fitted into each of two side wing portions 32 of the intercepting member 30.

As shown in FIG. 3, since multiple holes 41' are formed in the fitted portion 40' of each of the auxiliary intercepting plates 40, the auxiliary intercepting plates 40 are not separated from and are firmly fitted into the side wing portions 32 when the intercepting member 32 is expanded and contracted according to the expansion and contraction of the retaining wall W.

The retaining wall W is constructed by applying concrete to the stagnant water intercepting device, with the center portion being held between the two expanding and contracting strip members 10 and 10', the concave surface of the center portion facing the earth and sand heap S, the side wing portions 32 and the auxiliary intercepting plates 40 being positioned to form right angles with the two expanding and contracting strip members 10 and 10'.

In the stagnant water intercepting device of the present invention, since the multiple holes 41 in the auxiliary intercepting plate 40 are filled with the concrete when the device is laid in the retaining wall S, the device becomes firmly combined with the concrete after the concrete is hardened, thereby preventing the formation of a gap between the device and the concrete.

In addition, as shown in FIG. 3, since the holes 41' of the fitted portion 40' of the auxiliary intercepting plate 40 are filled with the material of the intercepting member 32, a gap between the auxiliary intercepting plate 40 and the intercepting member 32 is not formed.

As a result, after flowing into the retaining wall along the expanding and contracting strip member 10', water is intercepted by the auxiliary intercepting plate 40, thereby preventing the water from leaking out of the retaining wall along the expanding and contracting strip member 10.

The stagnant water intercepting device of the present invention may be used for a concrete floor T. In such a case, one expanding and contracting strip member 11 is interposed between divided concrete floors T, the convex surface of the center portion 31 is directed to the expanding and contracting strip member 11, the side wing portions 32 and the auxiliary intercepting plates 40 are positioned to form right angles with the expanding and contracting strip member 11, and the device is bonded to the floor by means of epoxy resin R.

Figure 6:
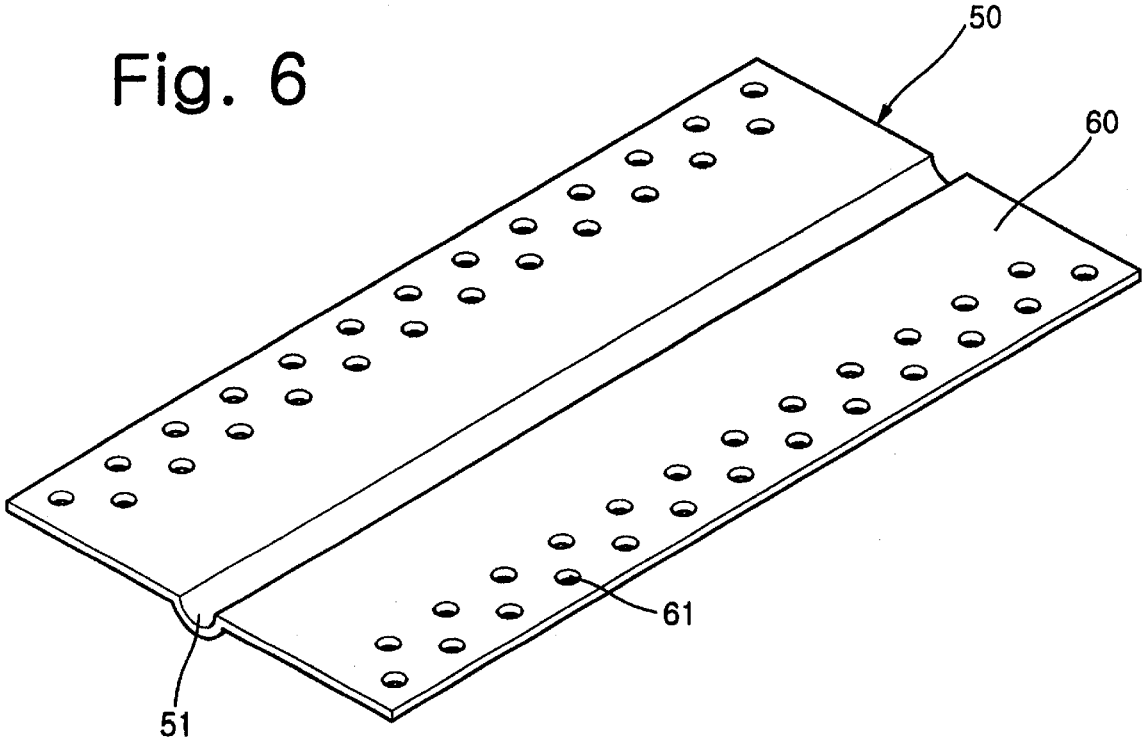
FIG. 6 is a perspective view showing a different stagnant water intercepting device according to another embodiment of the present invention.

Another embodiment of the present invention is illustrated in FIG. 6. This embodiment provides a stagnant water intercepting device 50 that comprises a semi-cylindrical center portion 51 and two intercepting side portions 60, the semi-cylindrical center portion 51 and the intercepting side portions 60 being integrated into a single body, each of the intercepting side portions 60 having a plurality of spaced holes 61.

In the stagnant water intercepting device 50 of the second embodiment, since the multiple holes 61 in the intercepting side portions 60 are filled with the concrete when the device is laid in the retaining wall S, the device 50 becomes firmly combined with the concrete after the concrete is hardened. As a result, the device 50 is not separated with the hardened concrete, so that the formation of a gap between the device 50 and the concrete is prevented.

As described above, the present invention provides a stagnant water intercepting device that prevents water from leaking out of a concrete construction structure.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A stagnant-water intercepting device, comprising:

an intercepting member consisting of a semi-cylindrical center portion and two side wing portions, said semi-cylindrical center portion and said side wing portions being integrated into a single body; and two auxiliary intercepting plates respectively provided with a plurality of spaced holes at their exposed portions and respectively and fixedly fitted into each of said side wing portions of the intercepting member, the portions of said intercepting plates fitted into said side wing portions of the intercepting member being each provided with a plurality of holes.

2. The device according to claim 1, wherein said intercepting plates are made of steel.

3. A stagnant-water intercepting device, comprising a semi-cylindrical center portion and two intercepting side portions, said semi-cylindrical center portion and said intercepting side portions being integrated into a single body, each of said intercepting side portions having a plurality of spaced holes, said spaced holes being located only in respective elongate edge areas of said intercepting side portions, each of said intercepting side portions having a respective elongate unperforated area disposed between the respective edge area and said semi-cylindrical center portion, said edge areas each having a width oriented perpendicularly to said semi-cylindrical center portion, said unperforated areas each having a width at least as large as the width of the respective edge area.

* * * * *